United States Patent [19]

Harshberger

[11] Patent Number: 4,729,322

[45] Date of Patent: Mar. 8, 1988

[54] CANTILEVERED TRAIN SYSTEM

[75] Inventor: Russell P. Harshberger, Covina, Calif.

[73] Assignee: Donald W. Harshberger, Covina, Calif.

[21] Appl. No.: 56,755

[22] Filed: Jun. 1, 1987

Related U.S. Application Data

[63] Continuation of Ser. No. 871852, Jun. 9, 1986, abandoned.

[51] Int. Cl.[4] ..... B61F 9/00; B60S 13/02

[52] U.S. Cl. ..... 104/245; 104/35; 105/215.1

[58] Field of Search ..... 104/35, 46, 242, 243, 104/245, 246; 105/199.1, 199.4, 215.1

[56] References Cited

U.S. PATENT DOCUMENTS

| | | | |
|---|---|---|---|
| 715,791 | 12/1902 | Happe | 104/243 |
| 1,545,747 | 7/1925 | Easton | 105/199.4 |
| 1,761,747 | 6/1930 | Rosin et al. | 104/35 |
| 2,727,102 | 12/1955 | Sawyer | 104/35 |
| 3,012,521 | 12/1961 | Lich | 105/199.4 |
| 3,152,559 | 10/1964 | Harshberger | 105/199.1 |
| 3,191,552 | 6/1965 | Koci | 105/199.1 |
| 3,672,308 | 6/1972 | Segar | 104/246 |
| 3,797,401 | 3/1974 | Alimanestianv | 105/215.1 |
| 3,817,186 | 6/1974 | Walsh | 104/243 |

FOREIGN PATENT DOCUMENTS

| | | | |
|---|---|---|---|
| 2841769 | 4/1980 | Fed. Rep. of Germany | 105/199.4 |

*Primary Examiner*—David A. Scherbel
*Assistant Examiner*—Donald T. Hajec
*Attorney, Agent, or Firm*—William W. Haefliger

[57] ABSTRACT

Apparatus to travel on primary rails includes:

(a) a truck having primary wheels adapted to roll on primary rails under the wheels;

(b) and side wheel structure carried by the truck and projecting at the side thereof, for car stabilizing upward engagement with elongated auxiliary rail structure above the side wheels, (c) three being a turnable having a vertical axis of pivoting, there also being extensions of the primary rails and of the auxilary rail structure on the turntable, all at one side of that vertical axis.

15 Claims, 9 Drawing Figures

CANTILEVERED TRAIN SYSTEM

This is a continuation, of application Ser. No. 871,853, filed June 9, 1987, now abandoned.

BACKGROUND OF THE INVENTION

This invention relates generally to rail cars and rails associated therewith and more particularly concerns a rail car and rail system providing substantial reduction in support structure width, without sacrificing safety or stability, and also providing enhanced structural safety and ride smoothness.

There is a need for rail and rail car type transit systems, as for example to reduce highway auto traffic; however existing system employing two support rails or tracks have drawbacks. Among these are the requirement for relatively widely spaced rails needed for car stability. This in turn requires undesirably wide rail separations and rail support structures, the expense of which increases with system right-of-way width, and rail support structure width. There are other problems with conventional systems, including excessive complexity. See also U.S. Pat. No. 3,152,559.

SUMMARY OF THE INVENTION

It is a major object of the invention to provide solutions to the above problems and difficulties. Basically, the invention is embodied in apparatus adapted to travel on primary rail means, and includes:

(a) a truck having primary wheel means adapted to roll on rail means under the wheel means, (b) and side wheel means carried by the truck and projecting at the side thereof for car stabilizing upward engagement with elongated auxiliary rail means above the side wheel means.

As will appear, the auxiliary rail means is sideward offset from the primary rail means and extends above the side wheel means for engagement therewith; and the side wheel means and side structure may typically include a first side wheel means and side structure may typically include a first side wheel and first axle projecting at one side of the truck, and a second side wheel and second axle projecting at the opposite side of the truck.

It is a further object of the invention to provide a car body that is eccentrically mounted on the truck to exert a force couple tending to elevate said side wheel means at one side of the truck. Further, pivot means is typically provided for mounting the car body on the truck to pivot between a first position in which the body exerts a force couple tending to elevate the first side wheel toward a first auxiliary rail thereabove, and second position in which the body exerts a force couple tending to elevate the second side wheel toward a second auxiliary rail thereabove.

It is a yet further object of the invention to provide springs on the truck to receive loading imposed by the car body in said first and second positions which act to yieldably resist car body tilting relative to the truck, the car body in each of said first and second positions being eccentrically mounted on and relative to the truck. In this regard, the car in the first and second positions is rotatable 180° on the truck. Spring retainers are advantageously pivotally mounted to the truck outwardly of said primary wheel means and allowing downward compression of the springs by car loading, the retainers holding the springs in compression for pre-loading same.

The above enables considerable space savings, for use of narrow gauge primary tracks, without sacrificing safety. Car switching is made easy due to rotation of the car body on the truck, for reverse directions travel, and provision of a turntable as will be described.

These and other objects and advantages of the invention, as well as the details of an illustrative embodiment, will be more fully understood from the following specification and drawings, in which:

DRAWING DESCRIPTION

Figure 4:
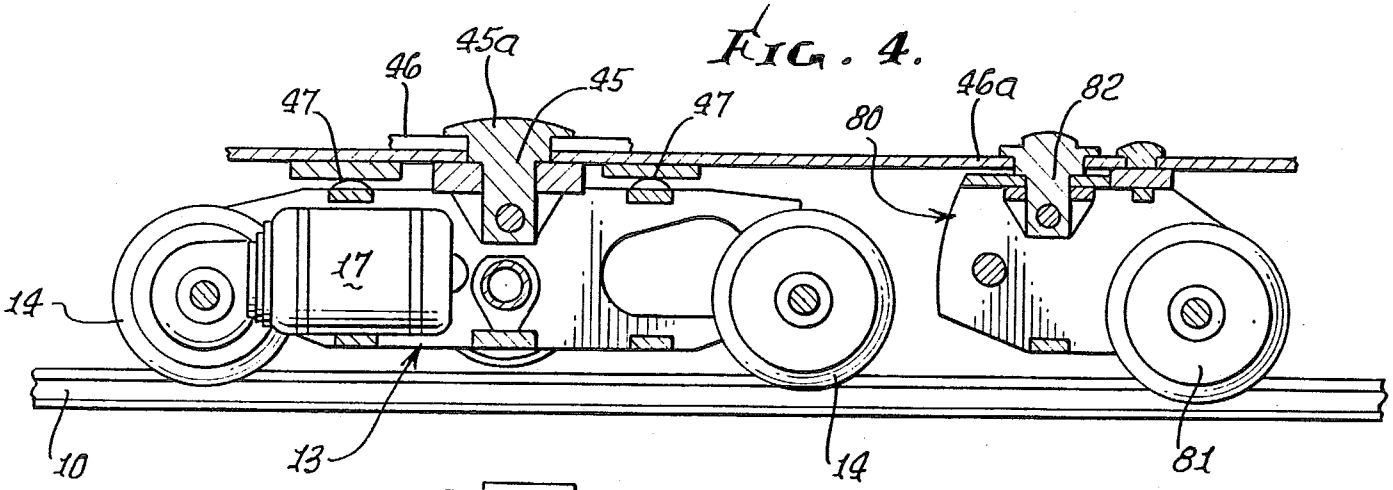
FIG. 4 is an enlarged view showing a rail car truck.
Figure 6:
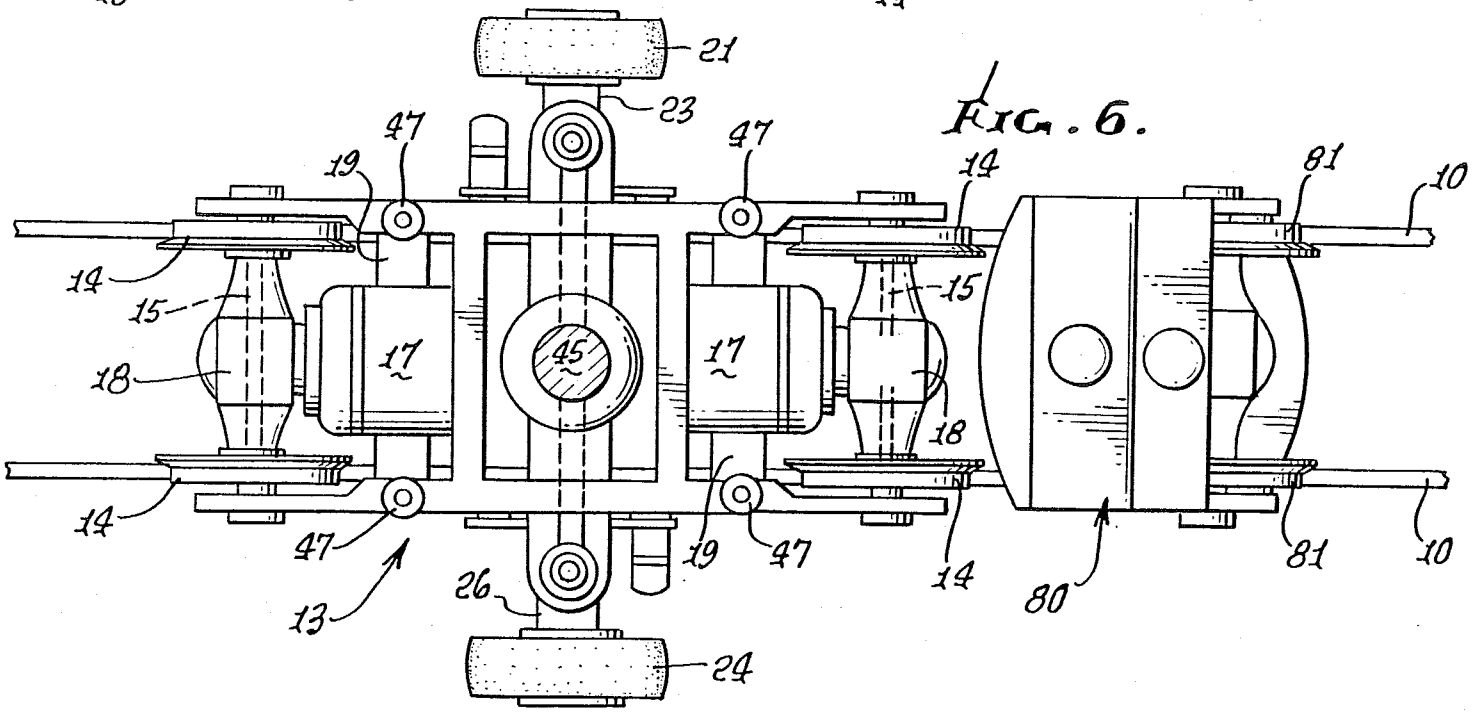
Figure 4A:
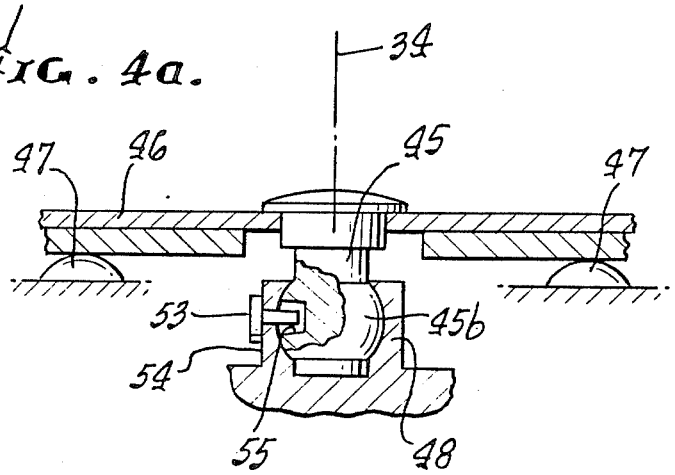
Figure 5:
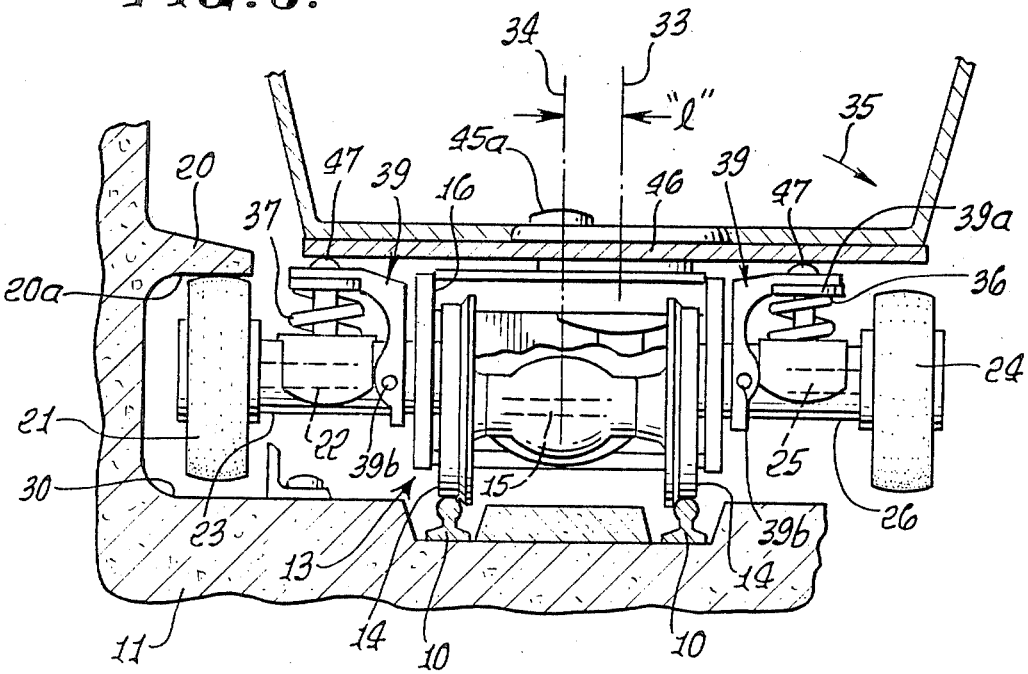

FIG. 4*a* is a fragmentary elevation showing rotatable support for the body, on the truck;

FIG. 5 is an end elevation of a car body on a truck, and side wheel support;

FIG. 6 is an enlarged plan view of a truck; and

Figure 7:
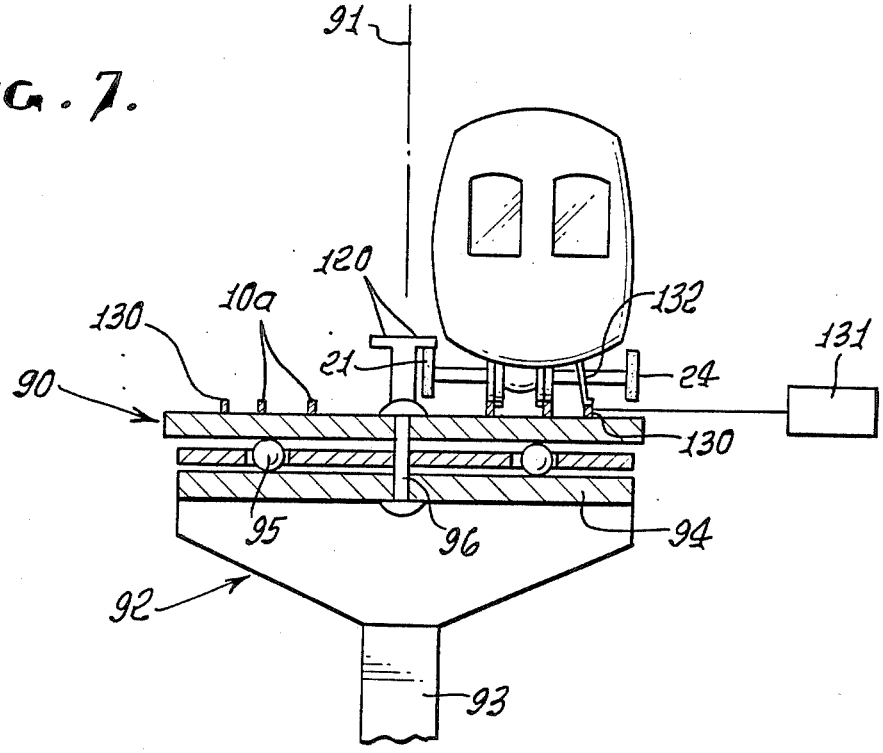
Figure 8:
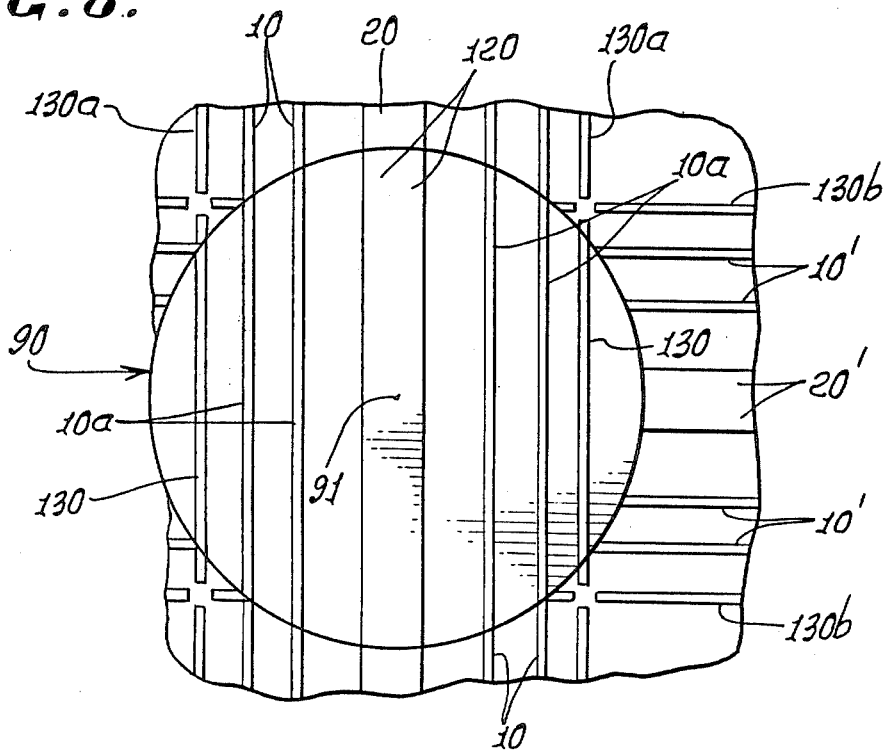

FIGS. 7 and 8 show turntable structure.

DETAILED DESCRIPTION

Figure 3:
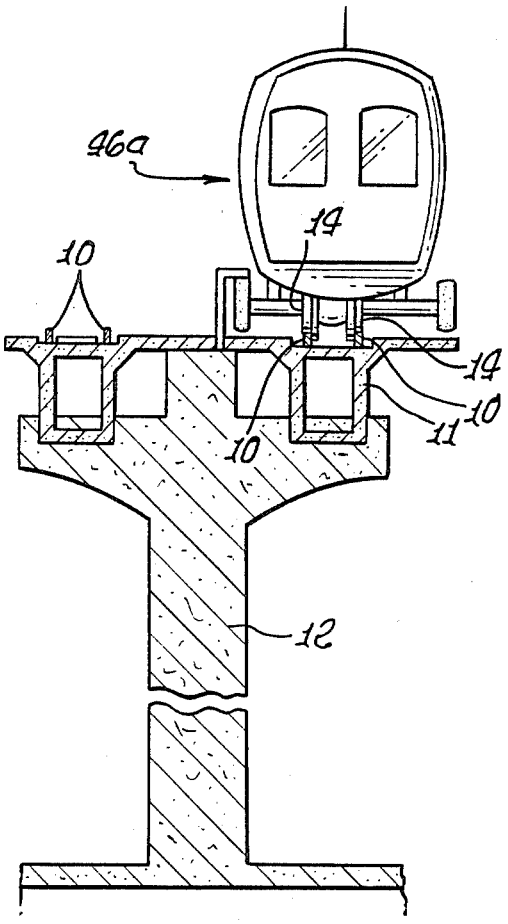
FIG. 3 is a view like FIG. 2 but showing a modification.

In the drawings, primary rail means includes two parallel rails 10 which may be of narrow gauge. Rail bed means 11 supports the rails and may be located on support pillars 12. Two such narrow gauge rail systems may be provided, as seen in FIG. 3, the overall width being minimized due to use of narrow gauges, for optimizing simplicity and reducing cost, including cost of right-of-way. See also FIG. 5.

A truck 13 has four wheels 14 engaging the rails 10, as better seen in FIG. 6. Wheels 14 are on axles 15 which carry truck bodies 16. An electric motor 17 may drive at least one of the axles to drive the car, as indicated in FIG. 6. A transmission is housed at 18, and motor 17 is carried by the truck structure 19.

Figure 2:
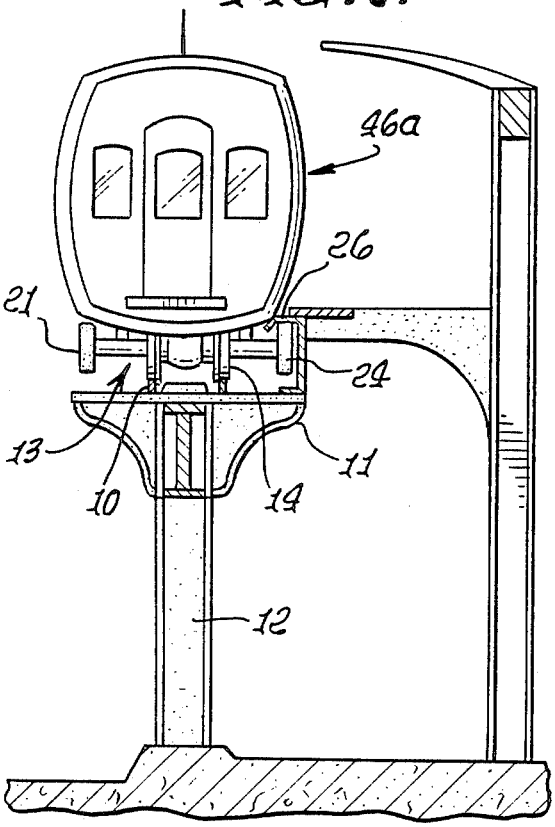
FIG. 2 is an end elevation showing the rail car of FIG. 1.

Side wheel means is carried by the truck, and projects at the side thereof, spaced laterally from the primary wheels 14, for car stabilizing upward engagement with elongated auxiliary rail means extending above the side wheel means. In the illustrated example, an auxiliary rail 20 (see FIG. 5) is in the form of a flange projecting sidewardly toward the truck 13; and a side wheel 21 is carried by the truck at one side thereof to extend immediately beneath the rail 20. An axle for wheel 21 is shown at 22, with a housing therefor at 23, suitable bearings located in the housing. Housing 23 attaches to the truck. Similarly, a second side wheel 24 and axle 25 therfor are carried at the opposite side of the truck, along with an axle housing 26. Wheel 24 is provided to extend directly beneath a side rail as indicated for example at 26 in FIG. 2. The side wheels 21 and 24 may include rubber tires, as shown, for smooth riding engagement with rails 20 and 26. The latter may consist of concrete, as indicated in FIG. 5, and be integral with a concrete bed for the primary rails.

One or both side wheels upwardly engage the auxiliary rail or rails, as provided for during car travel, to stabilize the car against tilting, as tends to occur to greater extent due to the narrow separation of narrow gauge rails 10. Also, the side wheel can engage the bed surface 30 beneath rail 20, as seen in FIG. 5. The vertical gap between the bed surface 30 and the under-surface 20*a* of rail 20 is slightly larger than the diameter of wheel 21, so that great stability against tilt is enabled. That gap can enlarge, as by relative elevation of rail 20, at curves in the car path of travel.

A further feature of the invention is the eccentric support of the car body mounted on the truck, to exert a force couple tending the elevate the side wheel means, as for example wheel 21 into engagement with rail surface 20*a*, during car travel. FIG. 5 shows such eccentric support, the vertical center line 33 of the car body offset at "1" from the vertical central plane 34 bisecting the truck. Thus, a couple or moment 35 is created by body weight exerted on the truck, and tends at times to lift wheel 21.

In FIG. 5, tilt of the body relative to the truck is resisted by springs 36 and 37 carried on the truck to receive car body imposed loading. Springs 36 and 37 also support the body when no tilt is present, to provide cushioning. Spring retainers 39 are pivotally attached to the structures 23 and 26 to extend over the springs at 39*a* for pre-loading same to create desired car-body counter-balancing upward force exerted by the pre-loaded springs. Pivots for the retainers are indicated at 39*b*.

Pivot means is also provided to mount the car body on the truck, to pivot between first and second positions (180° relative rotation). In each such position, the body exerts eccentric loading tending to create a force couple, as described. The pivot 45 seen in FIGS. 4 and 4*a* has a head 45*a* retaining the car body lower frame 46 downwardly at support locations 47. Referring to FIG. 4*a*, the pivot 45 may provide a spherical bearing at 45*b* received in correspondingly curved bearing housing 48 on the truck, thereby to allow body tilt. Pivot 45 allows 180° rotation of the car body about truck axis 34, as for example into opposite eccentric position seen in FIG. 2, wherein the opposite side wheel may engage an auxiliary rail at the opposite side of the car. In either body position, the body axis 33 is eccentrically located relative to axis 34. The body is indicated at 46*a*.

A lock pin 53 carried by the truck part 54 may extend into a suitable slot 55 in bearing 45 to lock the body in either of its two positions, against rotation about axis 34, but also to allow tilt of the bearing 45 as during body tilt relative to the truck, as resisted by springs 37. Pin 53 is removable to allow 180° rotation of the body about axis 34.

Figure 1:
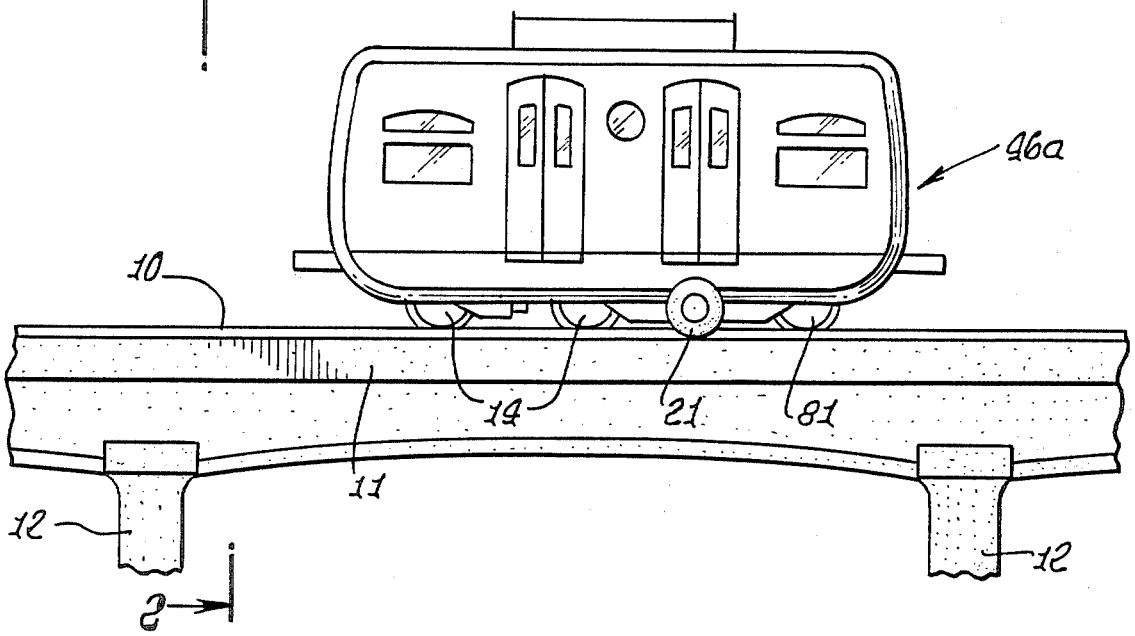
FIG. 1 is a side elevation showing a rail car embodying the invention.

FIGS. 1, 4 and 6 also show the provision of auxiliary support means for the rail car, including an undercarriage or auxiliary truck 80 spaced endwise from truck 13, and having support wheels 81 engaging rails 10. A vertical pivot 82 removably attaches carriage 80 to the car frame 46 part 46*a*, to allow body pivoting, as described, allowing car loading from any direction, and ready movement of cars on and off the trucks.

FIGS. 7 and 8 are elevational and plan views showing a turntable 90 rotatable about a vertical axis 91, and supporting extensions 10*a* of the primary rails 10, and extensions 120 of the auxiliary rail or rails 20. Structure supporting the turntable for rotation is indicated generally at 92, and includes a pedestal 93, base 94, bearings 95 and guide 96. Note in FIG. 8 the primary rails 10' extending at a selected angle (less than 180°) about axis 91 from rails 10; and auxiliary rails 20' extending at that same angle about axis 91 from auxiliary rails 20. Thus, when the truck is rolled onto the turntable, it can be rolled onto either rails 10 or 10' after selected rotation of the turntable, and the side wheel 21 can engage auxiliary rail 120 on the turntable, and auxiliary rail 20 or 20' depending on the off direction of the truck.

Corresponding additional rails 130, 130*a* and 130*b* are electrically energized (as at 131) to supply power to the electrical drive motor 17 carried by the truck, as via a sliding contact 132 carried by the truck. Such additional rails may be located at the inner side of rails 10 and 10*a*, i.e. closer to the pedestal than rails 10, for example.

A further advantage of the invention is found in the fact that the inside outrigger wheel rolls in reverse direction to the primary steel rail wheels, giving a downward force on the rail wheels. This factor makes it easier to "pick up" the guide rail during switching and gives additional traction to rail wheels.

I claim:

1. In combination, primary rail means and apparatus adapted to travel on said primary rail means, said apparatus comprising:

(a) a truck having primary wheel means adapted to roll on said primary rail means, (b) elongated auxiliary rail means, and side wheel means carried by the truck and projecting at the side thereof for car stabilizing upward engagement with said elongated auxiliary rail means, above the side wheel means, and above the level of said primary rail means, (c) said auxiliary rail means sidewardly offset from said primary rail means and extending above said side wheel means for engagement thereby, (d) and including a turntable supporting extensions of said primary rail means and of said auxiliary rail means, and structure supporting the turntable for rotation about a vertical axis, (e) said primary rail extensions including two rails both laterally offset from said vertical turntable axis, at one side thereof, and said auxiliary rail extension is located closer to said axis than said two rails, (f) and a car body eccentrically mounted on the truck to exert a force couple tending to elevate said side wheel menas toward said auxiliary rail means and said extension thereof.

2. The combination of claim 1 including an additional rail which is electrically energized to supply electrical current to a motor for driving the primary wheel means, and a contact carried by the truck and engaging the additional rail.

3. The combination of claim 2 wherein auxiliary rail means includes a rail surface facing downwardly to be engaged by said side wheel means, the side wheel means being spaced laterally from said primary wheel means.

4. The combination of claim 1 including side structure including axle means supporting said side wheel means.

5. The combination of claim 4 wherein said side wheel means and side structure include a first side wheel and first axle projecting at one side of the truck, and a second side wheel and second axle projecting at the opposite side of the truck.

6. The combination of claim 4 wherein said side wheel have peripheral rubber tires.

7. The combination of claim 4 including pivot means mounting the car body on the truck to pivot the body between a first position in which the body exerts a force couple tending to elevate the first side wheel toward a first auxiliary rail thereabove, and a second position in which the body exerts a force couple tending to elevate the second side wheel toward a second auxiliary rail thereabove.

8. The combination of claim 7 including springs on the truck to receive loading imposed by the car body in said first and second positions and acting to yieldably resist car body tilting relative to the truck, the car body in each of said first and second positions being eccentrically mounted on said relative to the truck.

9. The combination of claim 8 including spring retainer pivotally mounted to the truck outwardly to said primary wheel means and allowing downward compression of the springs by car loading, the retainers holding the springs in compression for pre-loading same.

10. The combination of claim 1 wherein said primary rail means includes two primary rails of narrow gauge.

11. The combination of claim 10 including an auxiliary truck supported by wheels on said narrow gauge rails, and the car body pivotally and removably attached to said auxiliary truck in spaced relation to said first mentioned truck.

12. The combination of claim 1 wherein said structure supporting the turntable for rotation includes ball bearing means.

13. The combination of claim 1 wherein said primary rail means and said auxiliary rail means extend in groups toward the turntable at selected angles less than 180 about an upright axis defined by the turntable.

14. The combination of claim 14 including an additional rail which is electrically energized to supply electrical current to a motor for driving the primary wheel means, and a contact carried by the truck and engaging the additional rail.

15. The combination of claim 1 including another pair of primary rail extensions including two rails on the turntable at the opposite side of said axis, and including another auxiliary rail extension associated with said other two rails and offset from said axis.

* * * * *